US006375272B1

(12) United States Patent
Ojanen

(10) Patent No.: US 6,375,272 B1
(45) Date of Patent: Apr. 23, 2002

(54) ROTATABLE CUTTING TOOL INSERT

(75) Inventor: Randall W. Ojanen, Bristol, TN (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/535,123

(22) Filed: Mar. 24, 2000

(51) Int. Cl.[7] ..... E21C 35/183
(52) U.S. Cl. ..... 299/111; 299/110
(58) Field of Search ..... 299/101–107, 299/110–111, 113

(56) References Cited

U.S. PATENT DOCUMENTS

| | | | | |
|---|---|---|---|---|
| 3,268,259 A | | 8/1966 | Snipe | |
| 4,159,746 A | * | 7/1979 | Wrulich et al. | 299/111 X |
| 4,201,421 A | | 5/1980 | Den Besten et al. | |
| 4,497,520 A | | 2/1985 | Ojanen | |
| 4,582,364 A | | 4/1986 | deMey, III | |
| 4,725,099 A | | 2/1988 | Penkunas et al. | |
| 4,821,819 A | * | 4/1989 | Whysong | 299/113 |
| 4,865,392 A | | 9/1989 | Penkunas et al. | |
| 4,893,875 A | | 1/1990 | Lonn et al. | |
| 4,921,310 A | | 5/1990 | Hedlund et al. | |
| 4,981,328 A | | 1/1991 | Stiffler et al. | |
| 5,054,217 A | | 10/1991 | Nilsson et al. | |

(List continued on next page.)

FOREIGN PATENT DOCUMENTS

| | | |
|---|---|---|
| DE | 2644992 C2 | 12/1987 |
| DE | 29504676 | 7/1995 |
| DE | 19803166 | 7/1999 |
| EP | 0295232 | 12/1988 |
| EP | 0757157 | 2/1997 |
| EP | 0908601 | 4/1999 |
| GB | 1294717 | 11/1972 |

OTHER PUBLICATIONS

Hurt, Rock Cutting experiments with point attack tools, Colliery Guardian Coal Interational, (1980), pp. 47, 49–50.

AMT Brochure entitled "Wear Characteristics" (4 pages) No Date.

Fansteel VR/Wesson–Lexington Advertisement entitled "Introduced a New Road Planing Bit" [1 page] (Date Unknown).

Fansteel VR/Wesson–Lexington Advertisement entitled ".765 Series R Carbide" [2 pages] (Date Unknown).

Fansteel VR/Wesson Mining & Construction Tools, Catalog 802 entitled "Construction Carbide Bits & Block", [12 pages] (Date Unknown).

GTE Competitive Evaluation Report (Jun. 29, 1982) [19 pages].

Sandvik Rock Tools Brochure for S–2000 road grading system [6 pages] (Date Unknown).

(List continued on next page.)

*Primary Examiner*—David Bagnell
*Assistant Examiner*—Sunil Singh
(74) *Attorney, Agent, or Firm*—Kevin P. Weldon

(57) ABSTRACT

A rotatable cutting tool for impinging the earth strata wherein the cutting tool has a tool body with an axial forward end and an axial rearward end. A hard insert is at the axial forward end and a retainer is carried by a shank portion near the axial rearward end. The hard insert has an axial forward generally conical tip section that presents a tip surface and has a starting included angle of between greater than about 110 degrees and less than about 140 degrees, a transition section (wherein at least a portion of the transition section presenting a convex shape) that is contiguous with and axially rearward of the tip section, a radially outwardly expanding first mediate section that is axially rearward of the convex section, and a base section that is axially rearward of the mediate section.

43 Claims, 6 Drawing Sheets

U.S. PATENT DOCUMENTS

| | | | | | |
|---|---|---|---|---|---|
| 5,074,623 | A | * | 12/1991 | Hedlund et al. | 299/111 |
| 5,131,725 | A | | 7/1992 | Rowlett et al. | |
| 5,161,627 | A | | 11/1992 | Burkett | 175/427 |
| 5,219,209 | A | | 6/1993 | Prizzi et al. | |
| 5,417,475 | A | * | 5/1995 | Graham et al. | 299/105 |
| 5,520,444 | A | * | 5/1996 | Kosobrodov et al. | 299/106 |
| 5,702,160 | A | | 12/1997 | Levankovskii et al. | 299/111 |
| 5,776,593 | A | | 7/1998 | Massa et al. | 428/212 |
| 5,845,547 | A | | 12/1998 | Sollami | |
| 6,003,623 | A | * | 12/1999 | Miess | 175/420 |
| 6,019,434 | A | | 2/2000 | Emmerich | |
| 6,199,956 | B1 | * | 3/2001 | Kammerer | 299/111 |

OTHER PUBLICATIONS

Stinger Brochure, P17164 Litho in U.S.A. (97–11).

Kennametal Brochure "Kennametal Scarifier Blades for Graders" (1999), AM99–4(10)C9.

Kennametal Inc. Drawing Nos. 80101672RO5, dated Jan. 30, 1997, and 92101312RO1, dated Mar. 6, 1997, corresponding to C855HD in above listed Kennametal Brochure.

PCT Search Report mailed Jan. 22, 2002, in PCT/US01/08135,international filing date Mar. 14, 2001.

* cited by examiner

ROTATABLE CUTTING TOOL INSERT

FIELD OF THE INVENTION

The invention pertains to a rotatable cutting tool that has a hard insert at the axial forward end thereof, the hard insert itself, and an assembly that includes the rotatable cutting tool and a tool holder.

BACKGROUND OF THE INVENTION

Heretofore, for applications such as road planning rotatable cutting tools have been used to break up the earth strata (e.g., asphalt pavement, asphaltic concrete or the like). Typically, the cutting tool has a hard (e.g., cemented [cobalt] tungsten carbide) insert at the axial forward end thereof and is rotatably retained by a tool holder which is attached to a driven member such as, for example, a chain, a wheel, or a drum. Under the influence of the driven member, the hard insert of the cutting tool impinges the surface of the earth strata so as to break or fracture the earth strata. In addition to road planning, rotatable cutting tools have been used for coal mining, trenching, and drilling. U.S. Pat. No. B1 4,497,520 to Ojanen and U.S. Pat. No. 4,725,099 to Penkunas et al. disclose rotatable cutting tools for road planning applications.

Because of the severe operating environment, the hard insert, as well as the entire rotatable cutting tool, is subjected to great forces. These forces can destroy the hard insert if it does not possess adequate fracture toughness. Thus, it would be desirable if the design of the hard insert would enhance the fracture toughness thereof.

These forces can also destroy the cutting tool if it fails to effectively rotate in the tool holder. It would also be desirable to provide a hard insert of a design that enhances the rotation of the cutting tool during operation.

SUMMARY OF THE INVENTION

In one form thereof, the invention is a rotatable cutting tool for impinging the earth strata. The tool comprises an elongate tool body that has an axial forward end and a hard insert affixed to the tool body at the axial forward end thereof. The hard insert has a central longitudinal axis. The hard insert is rotatable about the central longitudinal axis.

The hard insert includes an axial forward tip section that has a generally conical shape and is of an axial length. The tip section has a starting included angle of between greater than about 110 degrees and less than about 140 degrees along the axial length of the tip section. A transition section is contiguous with and axially rearward of the tip section and at least a portion of the transition section presents a convex shape. The hard insert has a radially outwardly expanding first mediate section axially rearward of the transition section, and a base section axially rearward of the first mediate section.

In another form thereof, the invention is a rotatable cutting tool for impinging the earth strata. The tool comprises an elongate tool body that has an axial forward end, and a hard insert affixed to the tool body at the axial forward end thereof. The hard insert includes an axial forward tip section that has a generally conical shape and has a starting included angle of between greater that about 110 degrees and less than about 140 degrees. A transition section is contiguous with and axially rearward of the tip section and at least a portion of the transition section presents a convex shape. The hard insert has a radially outwardly expanding first mediate section axially rearward of the transitions section, and a base section axially rearward of the mediate section. The hard insert further includes a second mediate section axially rearward of and contiguous with the first mediate section, and the second mediate section having a generally frusto-conical shape.

In another form thereof, the invention is a hard insert for attachment to a rotatable cutting tool for impinging earth strata. The hard insert comprises an axial forward generally conical tip section presenting a tip surface and having a starting included angle of between greater that about 110 degrees and less that about 140 degrees, and a transition section continuous with and axially rearward of the tip section wherein at least a portion of the transition section presenting a convex shape. The hard insert further has a radially outwardly expanding first mediate section axially rearward of the transition section, and a base section axially rearward of the mediate section. The hard insert further includes a second mediate section having a cylindrical shape and being contiguous with the transition section and with the first mediate section.

In still another form thereof, the invention is a hard insert for attachment to a rotatable cutting tool for impinging earth strata. The hard insert comprises an axial forward generally conical tip section presenting a tip surface and having a starting included angle of between greater than about 110 degrees and less than about 140 degrees, and a transition section contiguous with and axially rearward of the tip section wherein at least a portion of the transition section presenting a convex shape. The hard insert has a radially outwardly expanding first mediate section axially rearward of the transition section, and a base section axially rearward of the mediate section, wherein the first mediate section has a generally frusto-conical shape and is contiguous with the transition section. The hard insert further has a second mediate section axially rearward of and contiguous with the first mediate section wherein the second mediate section has a generally frusto-conical shape, and the included angle of the first mediate section is less than the included angle of the second mediate section.

In still another form, the invention is an assembly for impinging earth strata under the influence of a driven member wherein the assembly comprises a tool holder and the tool holder contains a bore. The assembly further includes a rotatable cutting tool having an axial forward end and an axial rearward end. The cutting tool has a hard insert at the axial forward end thereof and a shank portion near the axial rearward end thereof wherein the shank portion carries a retainer. The hard insert has a central longitudinal axis and the hard insert being rotatable about the central longitudinal axis thereof. The cutting tool is held by the tool holder wherein the shank portion is within the bore of the tool holder. The hard insert includes an axial forward generally conical tip section that presents a tip surface. The tip section has an axial length. The tip section has a starting included angle of between greater than about 110 degrees and less than about 140 degrees along the axial length of the tip section. The hard insert has a transition section contiguous with and axially rearward of the tip section, and a radially outwardly expanding first mediate section axially rearward of the transition section, and a base section axially rearward of the first mediate section. The rotatable cutting tool has an operational orientation such that when the rotatable cutting tool is in a new condition a relief angle between the surface of the tip section and the surface of the earth strata is less than or equal to about zero degrees.

In yet another form thereof, the invention is a rotatable cutting tool for impinging the earth strata. The tool comprises an elongate tool body having an axial forward end, a hard insert affixed to the tool body at the axial forward end thereof. The hard insert has a central longitudinal axis and is rotatable about the central longitudinal axis. The hard insert includes an axial forward tip section having a generally conical shape and having an axial length. The tip section has a starting included angle of between greater than about 110 degrees and less than about 140 degrees along the axial length of the tip section. The hard insert has a chamfered section contiguous with and axially rearward of the tip section, a cylindrical mediate section being axially rearward of and contiguous with the chamfered section, a radially outwardly expanding mediate section axially rearward of the chamfered section, and a base section axially rearward of the radially outwardly expanding mediate section.

In still another form thereof, the invention is a hard insert for attachment to a rotatable cutting tool for impinging earth strata. The hard insert comprises an axial forward generally conical tip section presenting a tip surface and having a starting included angle of between greater than about 110 degrees and less than about 140 degrees, and a transition section contiguous with and axially rearward of the tip section wherein at least a portion of the transition section presenting a convex shape. Another portion of the transition section includes a chamfered section axially rearward of and contiguous with the convex section. The hard insert has a radially outwardly expanding first mediate section axially rearward of the transition section, and a base section axially rearward of the mediate section, wherein the first mediate section has a generally frusto-conical shape and is contiguous with the transition section. The hard insert further has a second mediate section axially rearward of and contiguous with the first mediate section wherein the second mediate section has a generally frusto-conical shape, and the included angle of the first mediate section is less than the included angle of the second mediate section.

In yet another form thereof, the invention is a rotatable cutting tool for impinging the earth strata. The tool comprises an elongate tool body having an axial forward end wherein the elongate body has a central longitudinal axis. The cutting tool is rotatable about the central longitudinal axis. A hard insert is affixed to the tool body at the axial forward end thereof. The hard insert has a central longitudinal axis that is coaxial with the central longitudinal axis of the tool body. The hard insert includes an axial forward tip section having a generally conical shape and having an axial length. At least a portion of tip section presents in cross-section a pair of oppositely disposed generally straight lines wherein the interior angle between the generally straight lines defines a starting included angle of the tip section. The starting included angle of the tip section is between greater than about 115 degrees and less than about 125 degrees along the axial length of the axial forward tip section. The hard insert has a radially outwardly expanding mediate section axially rearward of the tip section, and a base section axially rearward of the radially outwardly expanding mediate section.

In another form thereof, the invention is an assembly for impinging earth strata under the influence of a driven member wherein the assembly comprises a tool holder that contains a bore. The assembly includes a rotatable cutting tool having an axial forward end and an axial rearward end. The cutting tool has a hard insert at the axial forward end thereof and a shank portion near the axial rearward end thereof wherein the shank portion carries a retainer. The rotatable cutting tool has a central longitudinal axis. The cutting tool is rotatable about the central longitudinal axis. The hard insert has a central longitudinal axis that is coaxial with the central longitudinal axis of the tool body. The cutting tool is held by the tool holder wherein the shank portion is within the bore of the tool holder. The hard insert includes an axial forward generally conical tip section having an axial length. At least a portion of the tip section presents in cross-section a pair of oppositely disposed generally straight lines wherein the interior angle between the generally straight lines defines a starting included angle of the tip section. The starting included angle of the tip section is between greater than about 115 degrees and less than about 125 degrees along the axial length of the axial forward tip section. The hard insert has a radially outwardly expanding mediate section that is axially rearward of the tip section, and a base section that is axially rearward of the radially outwardly expanding mediate section. The rotatable cutting tool has an operational orientation such that a relief angle between the generally planar surface of the tip section and the surface of the earth strata is less than or equal to about zero degree.

BRIEF DESCRIPTION OF THE DRAWINGS

The following is a brief description of the drawings that form a part of this patent application.

DETAILED DESCRIPTION OF THE INVENTION

Figure 1:
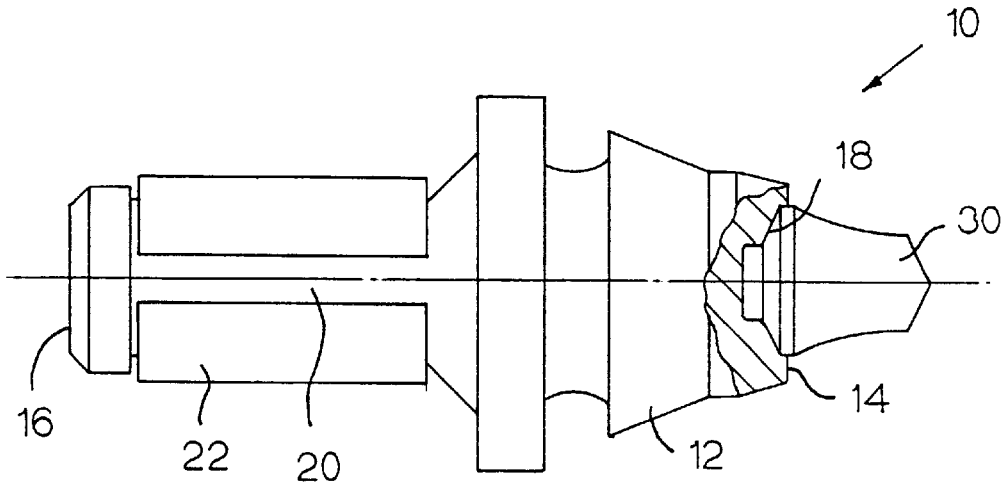
FIG. 1 is a side view of a specific embodiment of a rotatable cutting tool.

Referring to the drawings, FIG. 1 shows one specific embodiment of a rotatable cutting tool generally designated as 10. Cutting tool 10 has an elongate tool body 12 with an axial forward end 14 and an axial rearward end 16. The tool body 12 contains a socket 18 in the axial forward end 14, as well as a reduced diameter shank 20 adjacent the axial rearward end 16. The reduced diameter shank 20 carries a resilient retainer 22 that is similar to the sleeve shown and described in U.S. Pat. No. 4,201,421 to Den Besten et al. which is incorporated by reference herein.

A hard insert 30 is affixed (typically by brazing) into the socket 18. Hard insert 30 is typically a single monolithic piece formed by conventional powder metallurgical techniques.

Figure 2:
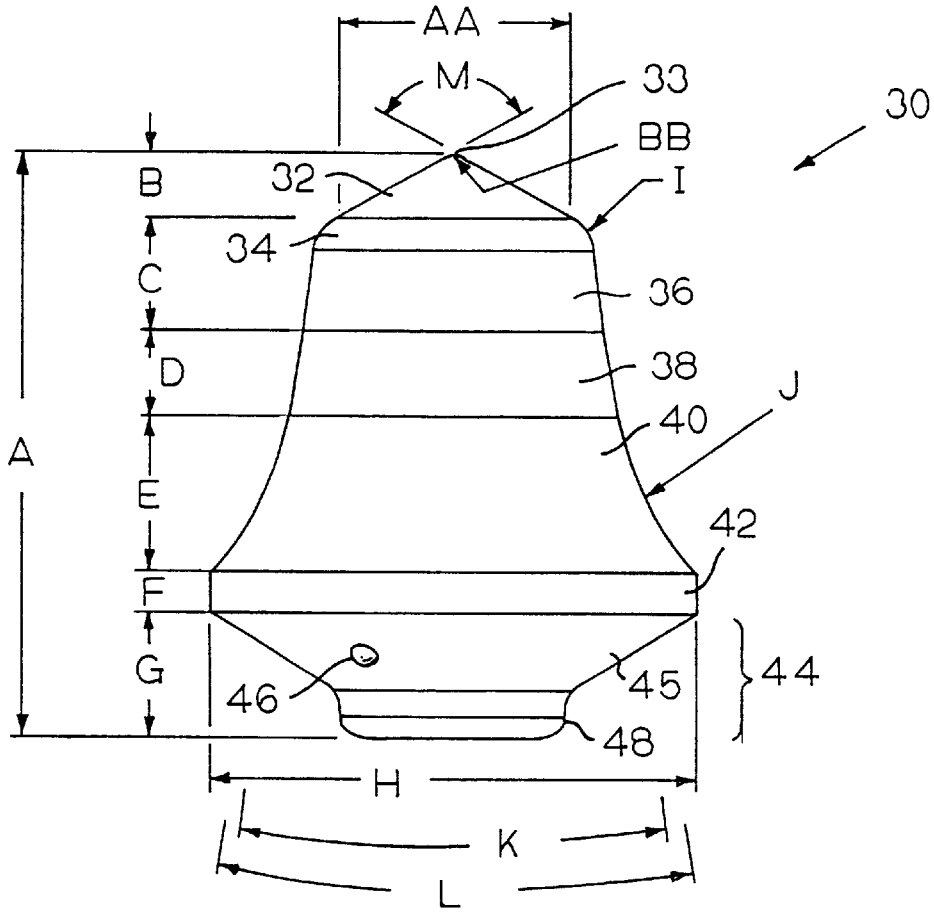
FIG. 2 is a side view of the hard insert of the tool of FIG. 1.

As shown in FIG. 2, Hard insert 30 has an overall axial length "A" of 0.883 inches [in.] (2.24 centimeters [cm]) and presents a series of coaxially aligned and integral sections as it moves from its axial forwardmost point in an axial rearward direction. The axial forwardmost section is a conical tip section 32 that presents a conical tip surface. Tip section 32 has a starting included angle "M" equal to 120 degrees, which is the included angle when the hard insert is in an unused condition. The tip section 32 further has an axial length "B" equal to 0.097 inches (0.246 cm), and a maximum first diameter "AA" equal to 0.345 inches (0.876 cm). The tip section 32 terminates in a radiused point 33 that has a radius "BB" equal to 0.032 inches (0.813 millimeters [mm]). A radiused convex section 34 of a radius "I" equal to 0.060 in. (0.152 cm) is contiguous with and axially rearward of the tip section.

Typically, the radius "I"of the radiused convex section 34 is equal to or greater than about ten percent of the dimension of the maximum diameter "AA"of the tip section 32; however, radius "I" can range between about ten percent and about twenty percent of the maximum diameter "AA" of the tip section. Furthermore, the magnitude of the radius "BB" of the point of the tip section is equal to or less than ten percent of the maximum diameter "AA" of the tip section.

A frusto-conical first mediate section 36, which is contiguous with and axially rearward of the convex section, has an included angle "K" equal to 10 degrees and together with the convex section 34 has an axial length "C" equal to 0.170 inches (0.432 cm). Although the specific embodiment shows a radiused section it should be appreciated that a chamfered section or the like may be contiguous with and axially rearward of the tip section so as to provide for a transition between the conical tip section and the frusto-conical first mediate section.

A frusto-conical second mediate section 38, which is contiguous with and axially rearward of the first mediate section, has an included angle "L" equal to 18 degrees and an axial length "D" equal to 0.127 inches (0.323 cm). An arcuate (i.e., concave) third mediate section 40, which is contiguous with and axially rearward of the second mediate section 38, has a radius of curvature "J" equal to 0.375 in. (0.953 cm) and an axial length "E" equal to 0.231 inches (0.587 cm).

The axial rearward region of the hard insert comprises a cylindrical base section 42 that has a diameter "H" equal to 0.750 in. (1.91 cm) and an axial length "F" equal to 0.070 in. (0.178 cm). Cylindrical base section 42 is contiguous with and axially rearward of the third mediate section 40. The axial rearward region further includes a rearward base section shown by brackets 44 that presents a frusto-conical surface 45 with a trio of equi-spaced apart spacer bumps 46 and a depending boss 48. The axial length "G" of the rearward base section 44 equals 0.188 in. (0.478 cm).

Figure 3:
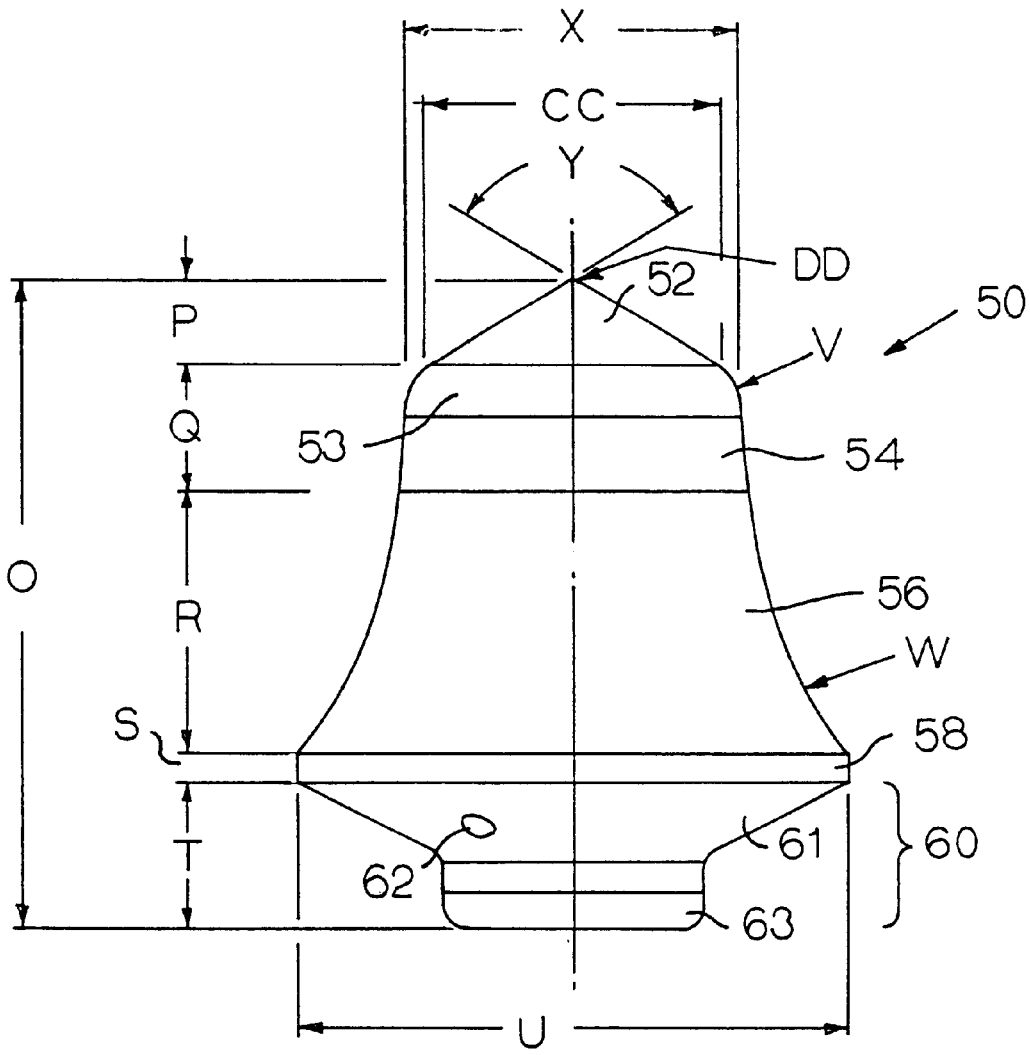
FIG. 3 is a side view of another specific embodiment of a hard insert.

Referring to FIG. 3, there is shown another specific embodiment of a hard insert generally designated as 50. Hard insert 50 is typically a single monolithic piece made by conventional powder metallurgical techniques.

Hard insert 50 has an overall axial length "O" equal to 0.864 in. (2.19 cm) and presents the following integral sections as it moves from its axial forwardmost point in an axial rearward direction. The axial forwardmost section is a conical tip section 52 that has an included angle "Y" equal to 120 degrees and an axial length "P" equal to 0.101 inches (0.257 cm). Tip section 52 presents a conical surface and terminates in a radiused point that has a radius "DD" equal to 0.032 inches (0.813 mm). Tip section 52 further has a maximum first diameter "CC" equal to 0.362 inches (0.919 cm).

A radiused convex section 53, which has a radius "V" equal to 0.090 in. (0.229 cm), is contiguous with and axially rearward of the tip section 52. A cylindrical first mediate section 54, which has a diameter "X" equal to 0.462 inches (1.173 cm), is contiguous with and axially rearward of the convex section. The cylindrical first mediate section and the convex section have a combined axial length "Q" equal to 0.178 inches (0.452 cm). An arcuate (i.e., concave) second mediate section 56, which has a radius "W" equal to 0.570 inches (1.448 cm) and an axial length "R" equal to 0.357 inches (0.907 cm), is contiguous with an axially rearward of the cylindrical first mediate section.

The axial rearward region of the hard insert has a cylindrical base section 58, which has a diameter "U" equal to 0.750 in. (1.905 cm) and an axial length "S" equal to 0.040 in. (0.102 cm). The cylindrical base section 58 is contiguous with and axially rearward of the second mediate section. The rearward region further has a rearward base section as shown by brackets 60 that has an axial length "T" equal to 0.188 in. (0.478 cm). Rearward base section 60 presents a frusto-conical surface 61 with a trio of equi-spaced apart spacer bumps 62 and a depending boss 63.

Figure 4:
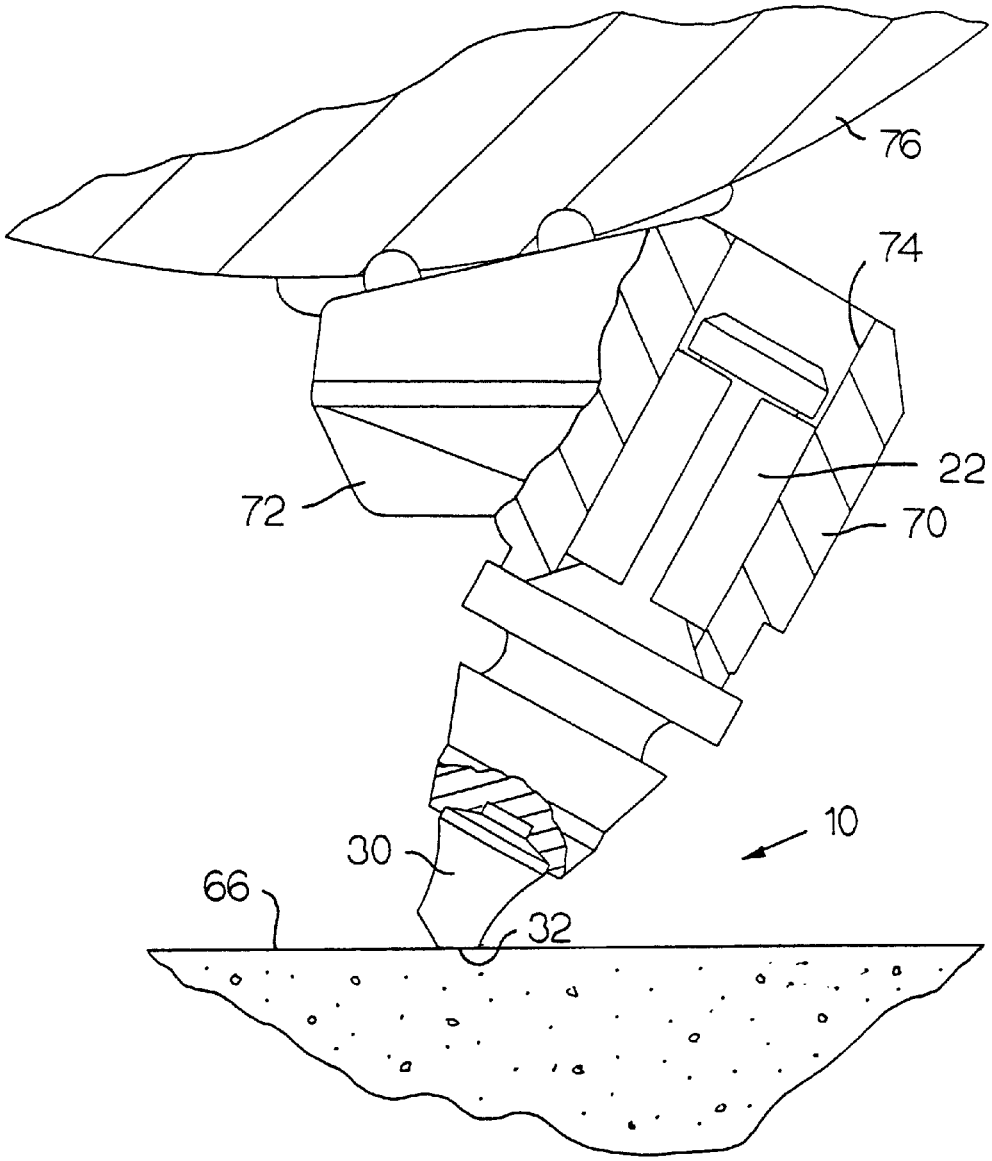
FIG. 4 is a side view of a road planning assembly wherein the cutting tool of FIG. 1 has an orientation so as to present a zero relief angle with respect to the earth strata during operation.

Referring to FIG. 4 there is shown cutting tool 10 (with hard insert 30 affixed thereto) and a tool holder 70 wherein tool holder 70 has a base 72 and a cylindrical bore 74. The resilient retainer sleeve 22 expands against the wall of the bore 74 so that the tool holder 70 rotatably retains (or carries) the cutting tool 10. The base 72 of the tool holder 70 is affixed to the surface of a road planning drum 76.

During the operation of the road planning assembly, the cutting tool has an orientation as shown in FIG. 4 such that there is no relief angle between the conical tip section 32 of the hard insert 30 and the roadway surface 66. In other words, substantially all of the surface of the conical tip section 32 contacts the roadway surface 66 at the beginning of the road planning operation. This orientation continues throughout the road planning operation so that substantially all of the wear due to actual impingement of the hard insert on the earth strata occurs along the surface of the conical tip section 32.

The contact between substantially the entire surface of the conical tip section 32 and the earth strata enhances the rotation of the cutting tool 10 during the road planning operation. More specifically, the existence of a greater amount of surface area that actually impinges and rubs against the surface of the earth strata together with the angle of attack enhances the rotation of the cutting tool. An increase in the distance the contact is away from the central longitudinal axis of the hard insert results in an increase in the extent to which such contact encourages rotation of the cutting tool. The contact provides optimum encouragement of rotation when such contact occurs along the entire surface of the conical tip section 32.

Substantially all of the wear of the hard insert due to impingement is on the surface of the conical tip section 32. This permits the axial forwardmost point 33 of the hard insert 30 to be of a smaller radius than of earlier hard insert designs where the point of the hard insert had to have a larger radius because it first impinged the earth strata.

Figure 5:
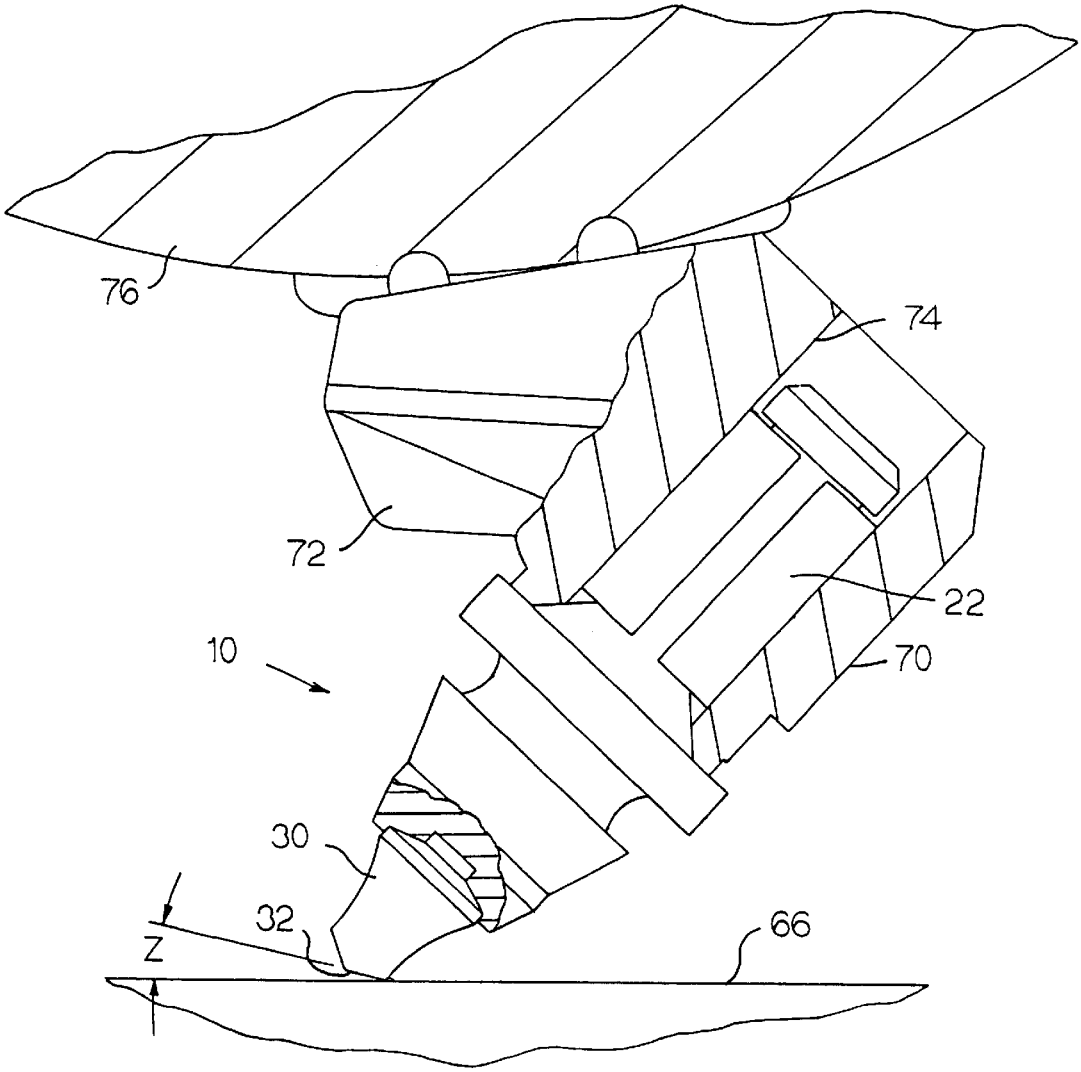
FIG. 5 is a side view of a road planning assembly wherein the cutting tool of FIG. 1 has an orientation so as to present a negative relief angle with respect to the earth strata during the initial operation.

Referring to FIG. 5 there is shown cutting tool 10 (with hard insert 30 affixed thereto) along with the tool holder 70 and the road planing drum 76. The initial orientation of the cutting tool 10 relative to the roadway surface 66 is such that there is a negative relief angle "Z" between the conical tip section 32 of the hard insert 30 and the roadway surface 66. In this orientation, the radiused convex section 34 of the hard insert 30 initially contacts the roadway surface 66 at the beginning of the road planing operation. Because the radiused section 34 presents a radius it has sufficient fracture toughness to withstand the operational forces. As the hard insert 30 wears, the wear due to impingement will eventually be along the surface of the conical tip section 32 so that the relief angle will then equal to zero degrees.

Figure 6:
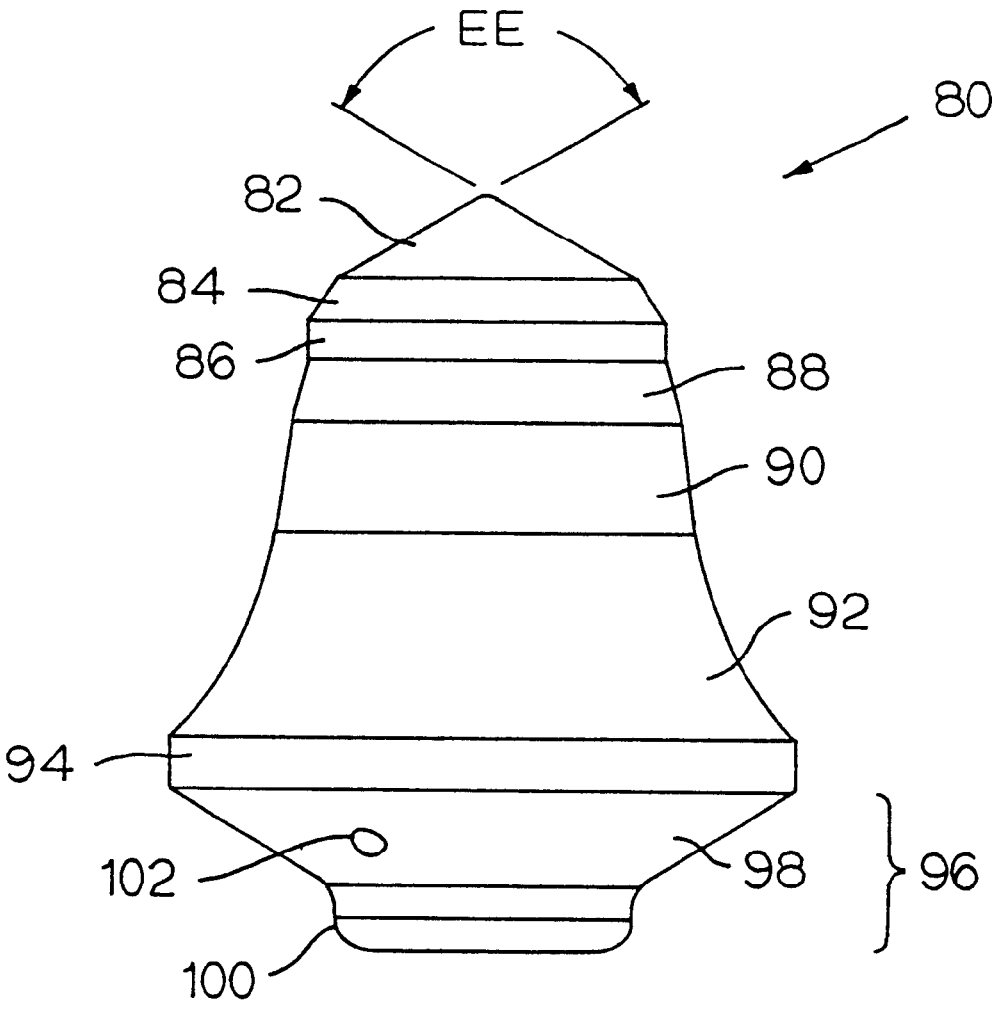
FIG. 6 is a side view of another specific embodiment of a hard insert.

Referring to FIG. 6, there is shown another specific embodiment of a hard insert generally designated as 80. Hard insert 80 has a conical tip section 82 that has an included angle "EE" equal to about one hundred twenty degrees. The included angle "EE" may range between about one hundred ten degrees and about one hundred forty degrees. A chamfered section 84 is axially rearward of and contiguous with the tip section 82. The chamfered section 84 may be entirely flat or may have a portion thereof that presents a convex shape.

A cylindrical mediate section 86 is axially rearward of and contiguous with the chamfered section 84. The maximum diameter of the chamfered section 84 is equal to the diameter of the cylindrical section 86. The presence of the cylindrical mediate section 86 provides a manufacturing advantage in that it permits the tip end plunger to complete its compression stroke on a vertical section of the die thereby reducing die wear and the associated problems of flashing accumulation and stress crack formation. In this regard, U.S. Pat. No. 4,725,099 to Penkunas et al. and U.S. Pat. No. 4,865,392 to Penkunas et al. each show a cylindrical section that joins the conical tip section so as to provide similar manufacturing advantages.

A first frusto-conical mediate section 88 is axially rearward of and contiguous with the cylindrical mediate section 86. A second frusto-conical mediate section 90 is axially rearward of and contiguous with the first frusto-conical section 88. An arcuate mediate section 92 is axially rearward of and contiguous with the second frusto-conical mediate section 90. A cylindrical base section 94 is axially rearward of and contiguous with the second frusto-conical mediate section 90. A rearward base section (shown by brackets 96) is axially rearward of and contiguous with the cylindrical base section 94. The rearward base section 96 comprises a frusto-conical portion 98 and a boss 100 wherein the frusto-conical portion 98 includes a trio of bumps 102 on the surface thereof. Although dimensions (e.g., angles, diameters and lengths) are not set forth, the dimensions of hard insert 80 may be along the lines of the dimensions of hard inserts 30 and 50.

Each one of the hard inserts 30, 50 and 80 is typically made from a cemented carbide material such as, for example, a cobalt-tungsten carbide alloy. Although the specific grade of cemented carbide depends upon the particular application for the cutting tool, rotatable cutting tools used in road planing applications may use a hard insert made of cobalt cemented tungsten carbide wherein the cobalt content ranges between about 5 weight percent to 13 weight percent with the balance comprising tungsten carbide. The hardness of the cemented tungsten carbide may range between about 86 and about 90.4 Rockwell A. A preferred grade of cemented tungsten carbide for a road planing application has a cobalt content that ranges between about 5.2 weight percent and about 6.3 weight percent with the balance being essentially tungsten carbide and the hardness ranging between 88.2 and 89.4 Rockwell A.

Figure 7:
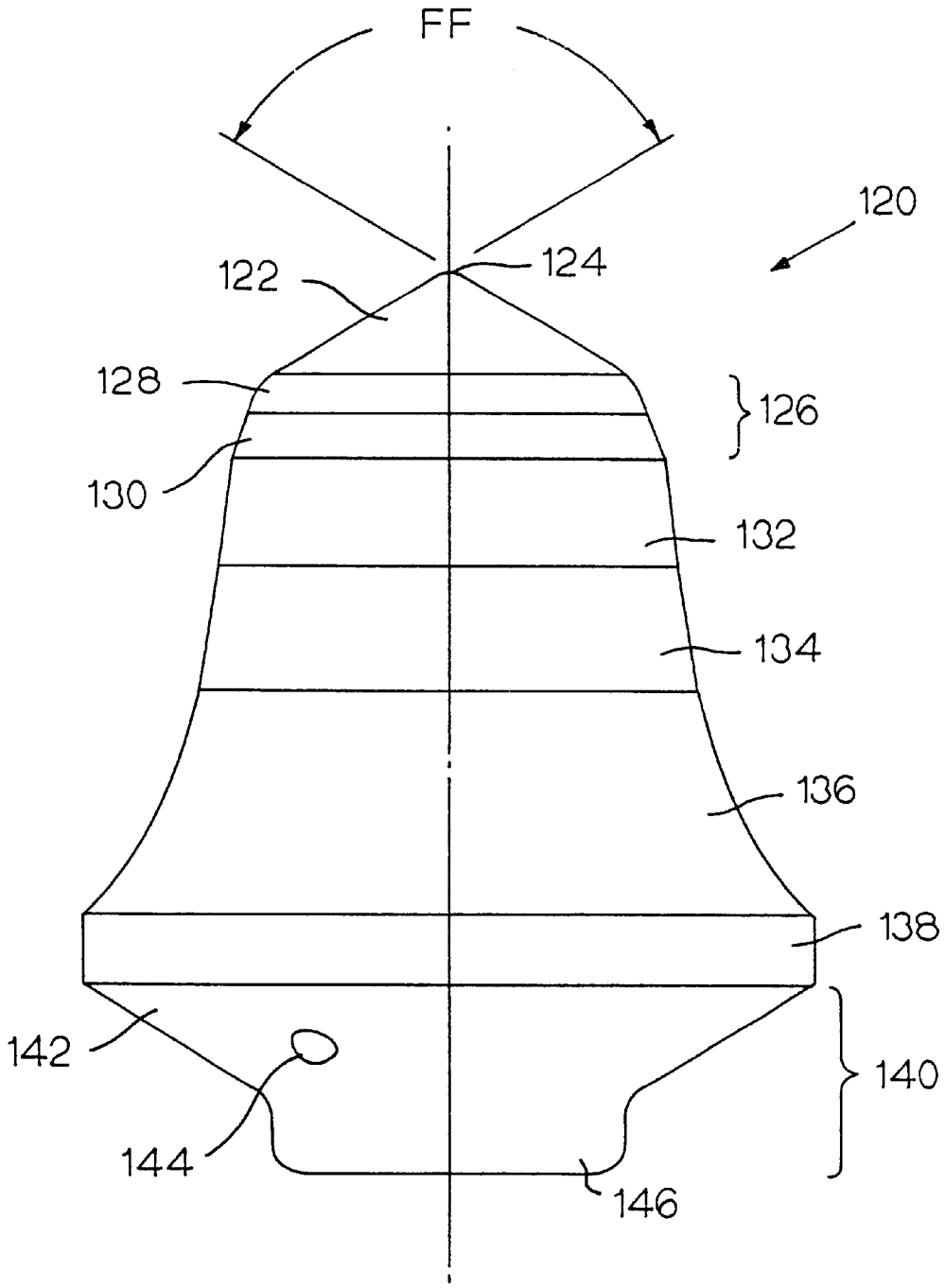
FIG. 7 is a side view of another specific embodiment of a hard insert.

As shown in FIG. 7, hard insert 120 presents a series of coaxially aligned and integral sections as it moves from its axial forwardmost point in an axial rearward direction. The axial forwardmost section is a conical tip section 122 that presents a conical tip surface. Tip section 122 has a starting included angle "FF" equal to about 120 degrees, which is the included angle when the hard insert is in a new unused condition. The tip section 122 terminates in a radiused point 124. A transition section (as shown in brackets 126) is axially rearward of and contiguous with the tip section 122. The transition section 126 comprises a radiused convex section 128 that is contiguous with and axially rearward of the tip section, and a chamfered section 130 that is axially rearward of and contiguous with the radiused convex section 128.

A frusto-conical first mediate section 132 is contiguous with and axially rearward of the chamfered section 130.

A frusto-conical second mediate section 134 is contiguous with and axially rearward of the first mediate section 132. An arcuate (i.e., concave) third mediate section 136 is contiguous with and axially rearward of the second mediate section 134.

The axial rearward region of the hard insert comprises a cylindrical base section 138 that is contiguous with and axially rearward of the third mediate section 136. The axial rearward region further includes a rearward base section shown by brackets 140 that presents a frusto-conical surface 142 with a trio of equi-spaced apart spaced bumps 144 and a depending boss 146.

As mentioned above, the hard inserts are typically brazed in the socket of the cutting tool body. The specific braze alloy may vary depending upon the particular application. One exemplary braze alloy include copper-zinc-nickel-manganese-silicon braze alloys sold by Handy & Harman, Inc. 859 Third Avenue, New York, N.Y. 10022 under the designations HI TEMP 080 and HI-TEMP 548. U.S. Pat. No. 5,219,209 to Prizzi et al. sets forth a more detailed description of this braze alloy. Two other exemplary braze alloys for road planing applications comprise either Nicumn 23 or Nicumn 37 each of which are sold by Wesgo. The composition of Nicumn 23 in weight percent is 67.5 percent copper, 23.5 percent manganese, and 9 percent nickel. The composition of Nicumn 37 (ASTM-4764) in weight percent is 52.5 percent copper, 38 percent manganese, and 9.5 percent nickel.

It is apparent that applicant has developed an improved rotatable cutting tool, an improved hard insert for a rotatable cutting tool, and an improved assembly that includes a tool holder along with the rotatable cutting tool with the hard insert. These improvements enhance the ability of the cutting tool to rotate during use and increase the fracture toughness of the hard insert so as to increase the useful life of the cutting tool.

All patents, patent applications and documents identified herein are hereby incorporated by reference herein.

Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed:

1. A rotatable cutting tool for impinging the earth strata, the tool comprising;

an elongate tool body having an axial forward end, a hard insert affixed to the tool body at the axial forward end thereof, the hard insert having a central longitudinal axis, the hard insert being rotatable about the central longitudinal axis; and the hard insert including an axial forward tip section having a generally conical shape and being of an axial length, the tip section having a starting included angle of greater than about 110 degrees and less than about 140 degrees along the axial length of the tip section, a transition section contiguous with and axially rearward of the tip section and at least a portion of the transition section presenting a convex shape, a radially outwardly expanding first mediate section axially rearward of the transition section, and a base section axially rearward of the first mediate section.

2. The rotatable cutting tool of claim 1 wherein the first mediate section of the hard insert having a generally frusto-conical shape and being contiguous with the transition section.

3. The rotatable cutting tool of claim 1 wherein substantially all of the transition section presenting a convex shape.

4. The rotatable cutting tool of claim 3 wherein the tip section having a maximum first diameter, and the transition section having a radius equal to or greater than about ten percent of the maximum first diameter.

5. The rotatable cutting tool of claim 4 wherein the radius of the transition section being between about ten percent and about twenty percent of the maximum first diameter.

6. The rotatable cutting tool of claim 1 wherein the tip section having a maximum first diameter, and the tip section terminating in a radiused point wherein the radius of the point being less than or equal to about ten percent of the first maximum diameter.

7. The rotatable cutting tool of claim 1 wherein a portion of the transition section being chamfered.

8. A rotatable cutting tool for impinging the earth strata, the tool comprising:

an elongate tool body having an axial forward end, a hard insert affixed to the tool body at the axial forward end thereof; and the hard insert including an axial forward tip section having a generally conical shape and having a starting included angle of greater than about 110 degrees and less than about 140 degrees, a transition section contiguous with and axially rearward of the tip section and at least a portion of the transition section presenting a convex shape, a radially outwardly expanding first mediate section axially rearward of the transition section, and a base section axially rearward of the first mediate section, wherein the hard insert further including a second mediate section axially rearward of and contiguous with the first mediate section, and the second mediate section having a generally frusto-conical shape.

9. The rotatable cutting tool of claim 8 wherein the included angle of the first mediate section being less than the included angle of the second mediate section.

10. The rotatable cutting tool of claim 9 wherein the hard insert further including a third mediate section having a concave shape, and the third mediate section being contiguous with and axially rearward of the second mediate section.

11. The rotatable cutting tool of claim 10 wherein the base section being contiguous with and axially rearward of the third mediate section.

12. A hard insert for attachment to a rotatable cutting tool for impinging earth strata wherein the hard insert has a central longitudinal axis and the hard insert being rotatable about the central longitudinal axis, the hard insert comprising: an axial forward generally conical tip section presenting a tip surface and having an axial length, and the hard insert having a starting included angle of greater than about 110 degrees and less than about 140 degrees along the axial length of the tip section, a transition section contiguous with and axially rearward of the tip section, at least a portion of the transition section presenting a convex shape, a radially outwardly expanding first mediate section axially rearward of the transition section, and a base section axially rearward of the first mediate section.

13. The hard insert of claim 12 wherein substantially all of the transition section presenting a convex shape.

14. The hard insert of claim 13 wherein the tip section having a maximum first diameter, and the transition section having a radius equal to or greater than about ten percent of the maximum first diameter.

15. The hard insert of claim 14 wherein the radius of the transition section being between about ten percent and about twenty percent of the maximum first diameter.

16. The hard insert of claim 12 wherein the tip section having a maximum first diameter, and the tip section terminating in a radiused point wherein the radius of the point being equal to or less than about ten percent of the first maximum diameter.

17. The hard insert of claim 12 wherein a portion of the transition section being chamfered.

18. A hard insert for attachment to a rotatable cutting tool for impinging earth strata, the hard insert comprising: an axial forward generally conical tip section presenting a tip surface and having a starting included angle of greater than about 110 degrees and less than about 140 degrees, a transition section contiguous with and axially rearward of the tip section, at least a portion of the transition section presenting a convex shape, a radially outwardly expanding second mediate section axially rearward of the transition section, and a base section axially rearward of the second mediate section, further including a first mediate section having a cylindrical shape and being contiguous with the transition section and with the second mediate section.

19. The hard insert of claim 18 wherein the second mediate section having a concave shape, and the second mediate section being contiguous with the base section.

20. A hard insert for attachment to a rotatable cutting tool for impinging earth strata, the hard insert comprising: an axial forward generally conical tip section presenting a tip surface and having a starting included angle of greater than about 110 degrees and less than about 140 degrees, a transition section contiguous with and axially rearward of the tip section, at least a portion of the transition section presenting a convex shape, a radially outwardly expanding first mediate section axially rearward of the transition section, and a base section axially rearward of the first mediate section, wherein the first mediate section having a generally frusto-conical shape and being contiguous with the transition section, a second mediate section axially rearward of and contiguous with the first mediate section, the second mediate section having a generally frusto-conical shape, and the included angle of the first mediate section being less than the included angle of the second mediate section.

21. The hard insert of claim 20 further including a third mediate section having a concave shape, and the third mediate section being contiguous with and axially rearward of the second mediate section.

22. The hard insert of claim 21 wherein the base section being contiguous with and axially rearward of the third mediate section.

23. An assembly for impinging earth strata under the influence of a driven member wherein the assembly comprises:

a tool holder and the tool holder containing a bore;

a rotatable cutting tool having an axial forward end and an axial rearward end, the cutting tool having a hard insert at the axial forward end thereof and a shank portion near the axial rearward end thereof wherein the shank portion carries a retainer;

the hard insert having a central longitudinal axis, the hard insert being rotatable about the central longitudinal axis thereof;

the cutting tool being held by the tool holder wherein the shank portion being within the bore of the tool holder;

the hard insert including an axial forward generally conical tip section presenting a tip surface, the tip section having an axial length, the tip section having a starting included angle of greater than about 110 degrees and less than about 140 degrees along the axial length of the tip section, a transition section contiguous with and axially rearward of the tip section, a radially outwardly expanding first mediate section axially rearward of the transition section, and a base section axially rearward of the first mediate section; and wherein the rotatable cutting tool having an operational orientation such that when the rotatable cutting tool is in a new condition a relief angle between the surface of the tip section and the surface of the earth strata is less than or equal to about zero degrees.

24. The assembly of claim 23 wherein the rotatable cutting tool having an operational orientation such that when the rotatable cutting tool is in a new condition a relief angle between the surface of the tip section and the surface of the earth strata is equal to about zero degrees.

25. The assembly of claim 23 wherein the rotatable cutting tool having an operational orientation such that when the rotatable cutting tool is in a new condition a relief angle between the surface of the tip section and the surface of the earth strata is equal to less than about zero degrees.

26. The assembly of claim 23 wherein at least a portion of the transition section of the hard insert presenting a convex shape.

27. The assembly of claim 23 wherein substantially all of the transition section presenting a convex shape.

28. The assembly of claim 23 wherein a portion of the transition section being chamfered.

29. A rotatable cutting tool for impinging the earth strata, the tool comprising;

an elongate tool body having an axial forward end, a hard insert affixed to the tool body at the axial forward end thereof;

the hard insert having a central longitudinal axis, the hard insert being rotatable about the central longitudinal axis; and the hard insert including an axial forward tip section having a generally conical shape and having an axial length, the tip section having a starting included angle of greater than about 110 degrees and less than about 140 degrees along the axial length of the tip section; a chamfered section contiguous with and axially rearward of the tip section, a cylindrical mediate section being axially rearward of and contiguous with the chamfered section, a radially outwardly expanding mediate section axially rearward of the chamfered section, and a base section axially rearward of the radially outwardly expanding mediate section.

30. A rotatable cutting tool for impinging the earth strata, the tool comprising:

an elongate tool body having an axial forward end, the elongate body having a central longitudinal axis, the cutting tool being rotatable about the central longitudinal axis;

a hard insert affixed to the tool body at the axial forward end thereof, the hard insert having a central longitudinal axis being coaxial with the central longitudinal axis of the tool body; and the hard insert including an axial forward tip section having a generally conical shape and having an axial length, at least a portion the tip section presenting in cross-section a pair of oppositely disposed generally straight lines wherein the interior angle between the generally straight lines defining a starting included angle of the tip section, and the starting included angle of the tip section being greater than about 115 degrees and less than about 125 degrees along the axial length of the axial forward tip section, a radially outwardly expanding mediate section axially rearward of the tip section, and a base section axially rearward of the radially outwardly expanding mediate section.

31. The rotatable cutting tool of claim 30 wherein the starting included angle of the tip section equaling about 120 degrees.

32. The rotatable cutting tool of claim 30 further including a transition section contiguous with and axially rearward of the tip section and at least a portion of the transition section presenting a convex shape.

33. The rotatable cutting tool of claim 32 wherein substantially all of the transition section presenting a convex shape.

34. The rotatable cutting tool of claim 33 wherein the tip section having a maximum first diameter, and the transition section having a radius equal to or greater than about ten percent of the maximum first diameter.

35. The rotatable cutting tool of claim 34 wherein the radius of the transition section being between about ten percent and about twenty percent of the maximum first diameter.

36. The rotatable cutting tool of claim 30 further including a transition section contiguous with and axially rearward of the tip section, and wherein a portion of the transition section being chamfered.

37. The rotatable cutting tool of claim 30 wherein the tip section having a maximum first diameter, and the tip section terminating in a radiused point wherein the radius of the point being less than or equal to about ten percent of the first maximum diameter.

38. An assembly for impinging earth strata under the influence of a driven member wherein the assembly comprises:

a tool holder, and the tool holder containing a bore;

a rotatable cutting tool having an axial forward end and an axial rearward end, the cutting tool having a hard insert at the axial forward end thereof and a shank portion near the axial rearward end thereof wherein the shank portion carries a retainer, the rotatable cutting tool having a central longitudinal axis, and the cutting tool being rotatable about the central longitudinal axis;

the hard insert having a central longitudinal axis being coaxial with the central longitudinal axis of the tool body;

the cutting tool being held by the tool holder wherein the shank portion being within the bore of the tool holder;

the hard insert including an axial forward generally conical tip section having an axial length, at least a portion of the tip section presenting in cross-section a pair of oppositely disposed generally straight lines wherein the interior angle between the generally straight lines defining a starting included angle of the tip section, and the starting included angle of the tip section greater than about 115 degrees and less than about 125 degrees along the axial length of the axial forward tip section, a radially outwardly expanding mediate section axially rearward of the tip section, and a base section axially rearward of the radially outwardly expanding mediate section; and wherein the rotatable cutting tool having an operational orientation such that a relief angle between the generally planar surface of the tip section and the surface of the earth strata is less than or equal to about zero degrees.

39. The assembly of claim 38 wherein the relief angle being equal to about zero degrees.

40. The assembly of claim 38 wherein the relief angle being equal to less than zero degrees.

41. The assembly of claim 38 further including a transition section contiguous with and axially rearward of the tip section, and wherein at least a portion of the transition section presenting a convex shape.

42. The assembly of claim 41 wherein substantially all of the transition section presenting a convex shape.

43. The assembly of claim 38 further including a transition section contiguous with and axially rearward of the tip section, and wherein a portion of the transition section being chamfered.

* * * * *